United States Patent [19]

Schulze

[11] Patent Number: 4,741,175

[45] Date of Patent: May 3, 1988

[54] AUTO DEFROST REFRIGERATOR

[75] Inventor: James L. Schulze, Louisville, Ky.

[73] Assignee: General Electric Company, Louisville, Ky.

[21] Appl. No.: 26,617

[22] Filed: Mar. 17, 1987

[51] Int. Cl.[4] ..... F25D 11/02

[52] U.S. Cl. ..... 62/442; 62/445; 62/526

[58] Field of Search ..... 62/441–445, 62/415, 526

[56] References Cited

U.S. PATENT DOCUMENTS

| | | | |
|---|---|---|---|
| 2,739,456 | 3/1956 | Saunders | 62/441 X |
| 2,741,095 | 4/1956 | Jacobs | 62/441 X |
| 3,004,400 | 10/1961 | Mann et al. | 62/441 X |
| 3,136,138 | 6/1964 | Muffly | 62/526 X |
| 3,382,683 | 5/1968 | Wiljanen | 62/441 X |
| 4,250,719 | 2/1981 | Grimm et al. | 62/382 |
| 4,509,335 | 4/1985 | Griffin et al. | 62/77 |

*Primary Examiner*—William E. Tapolcai
*Attorney, Agent, or Firm*—Radford M. Reams; Frederick P. Weidner

[57] ABSTRACT

A refrigerator includes a freezer compartment, a fresh food compartment and an evaporator chamber. Air is circulated between the chamber and each compartment. Air from the fresh food compartment is returned through a return duct. The evaporator has one section in the evaporator chamber and another section in the return air duct so that the fresh food compartment return air passes over both of the evaporator sections while the freezer return air passes over only the evaporator section in the evaporator chamber.

10 Claims, 2 Drawing Sheets

AUTO DEFROST REFRIGERATOR

BACKGROUND OF THE INVENTION

This invention relates to household refrigerators of the type having a fresh food storage compartment and a freezer or freezing compartment above the fresh food compartment. More particularly it relates to such refrigerators in which air is chilled by a separate evaporator, with a portion of the cold air being circulated through the freezer compartment and another portion of the cold air being circulated through the fresh food compartment.

In some prior art refrigerators, such as disclosed in U.S. Pat. No. 3,379,029-King, assigned to General Electric Company, assignee of the present invention, there is provided an upper freezing compartment and a lower fresh food compartment separated by a horizontal insulating partition. An evaporator chamber is formed at the rear of the freezer compartment. The fan in the evaporator chamber draws air from each of the freezer compartment and the fresh food compartment into the evaporator chamber where it mixes and passes over the evaporator. The fan discharges the chilled air from the evaporator chamber into the freezer compartment and a portion of this air then goes into the fresh food compartment. As the air flows through the freezer and fresh food compartments, particularly the fresh food compartment, it absorbs moisture. Then, as it passes over the evaporator much of the moisture condenses out and deposits as frost on the evaporator coils. In order to keep the evaporator in proper working condition this frost periodically must be melted and removed from the evaporator chamber. Because of the low temperture in the evaporator chamber this defrosting step must be repeated fairly often and care must be taken to assure that the temperature of the adjacent freezer compartment does not rise too much during defrost operations.

In accordance with the present invention a construction is provided in an improved refrigerator wherein a duct is formed at the rear of the fresh food compartment for returning air from the fresh food compartment to the evaporator chamber. Another section or extension of the evaporator is positioned in this duct and precools the fresh food return air. Preferably the evaporator extension is effective to cool the fresh food return air to about the same temperature as the freezer return air. This arrangement more effectively utilizes the capacity of the refrigerant.

Most of the moisture in the fresh food return air condenses and deposits on the evaporator extension as frost. When the compressor turns off the duct and the evaporator extension warm-up the frost melts and is disposed of. Since the fresh food return air contains most of the moisture, less frost is deposited on the evaporator section in the evaporator chamber and more time can elapse between defrost operations.

SUMMARY OF THE INVENTION

In carrying out the objects of this invention, in one form thereof, there is provided a refrigerator including an upper freezer compartment, a lower fresh food compartment and a insulating partition separating the compartments. Cold air from an evaporator chamber is conducted to the freezer compartment and to the fresh food compartment and relatively warm air is returned from these compartments to the chamber. Duct means is provided for connecting the lower portion of the fresh food compartment with the evaporator chamber for returning the relatively warm air from the fresh food compartment. An evaporator includes a first evaporator section positioned in the evaporator chamber and a second evaporator section positioned in the duct for chilling air passing thereover. Fan means withdraws relatively warm air from the compartments, circulates the air from the freezer compartment over the first evaporator section, circulates the air from the fresh food compartment serially over both the second and first evaporator sections and discharges cooled air from the evaporator chamber back to the compartments.

DESCRIPTION OF THE PREFERRED EMBODIEDMENT

Figure 1:
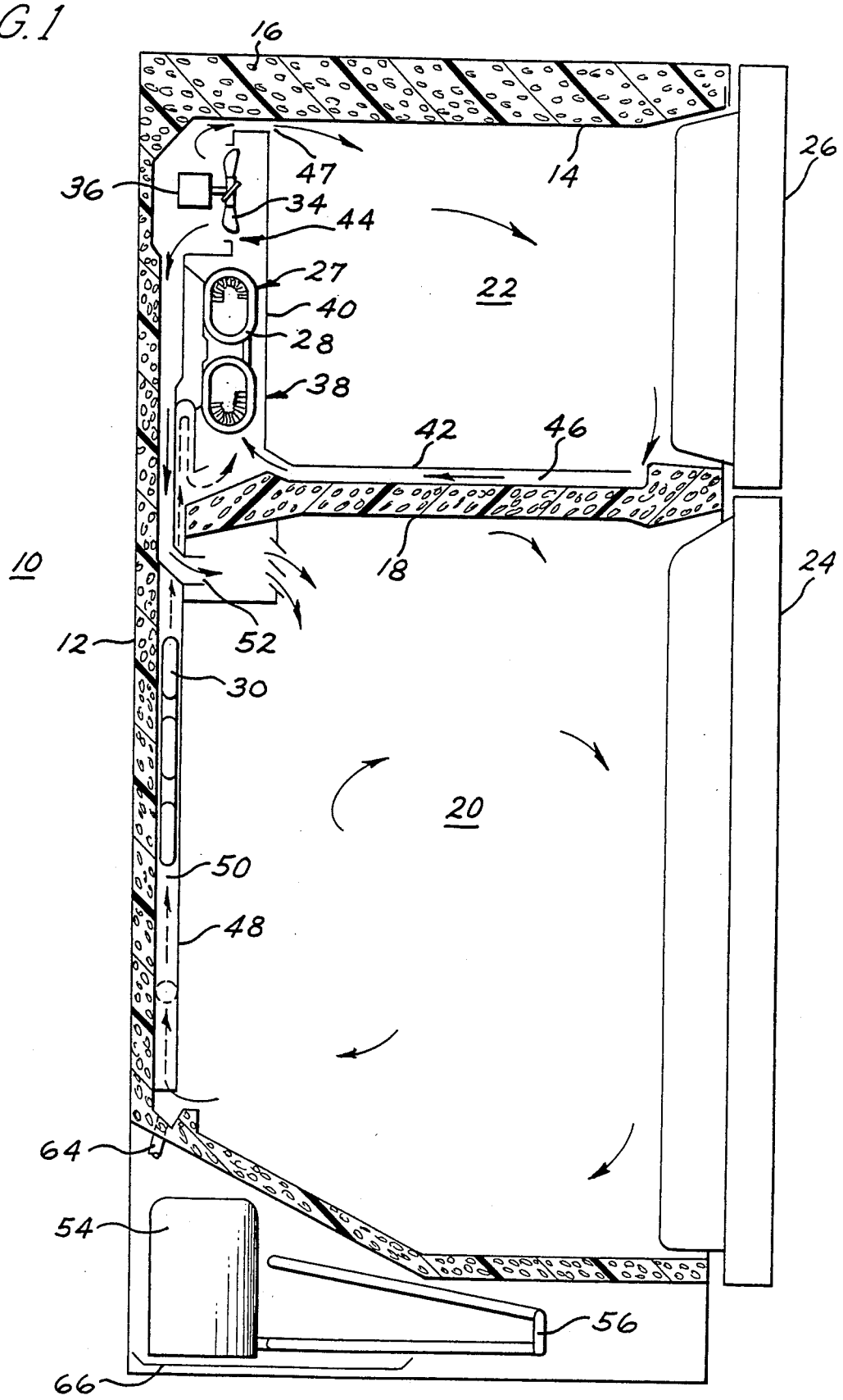
FIG. 1 is a somewhat schematic side elevational view, partially in section, of a refrigerator cabinet incorporating one form of the present invention.
Figure 2:
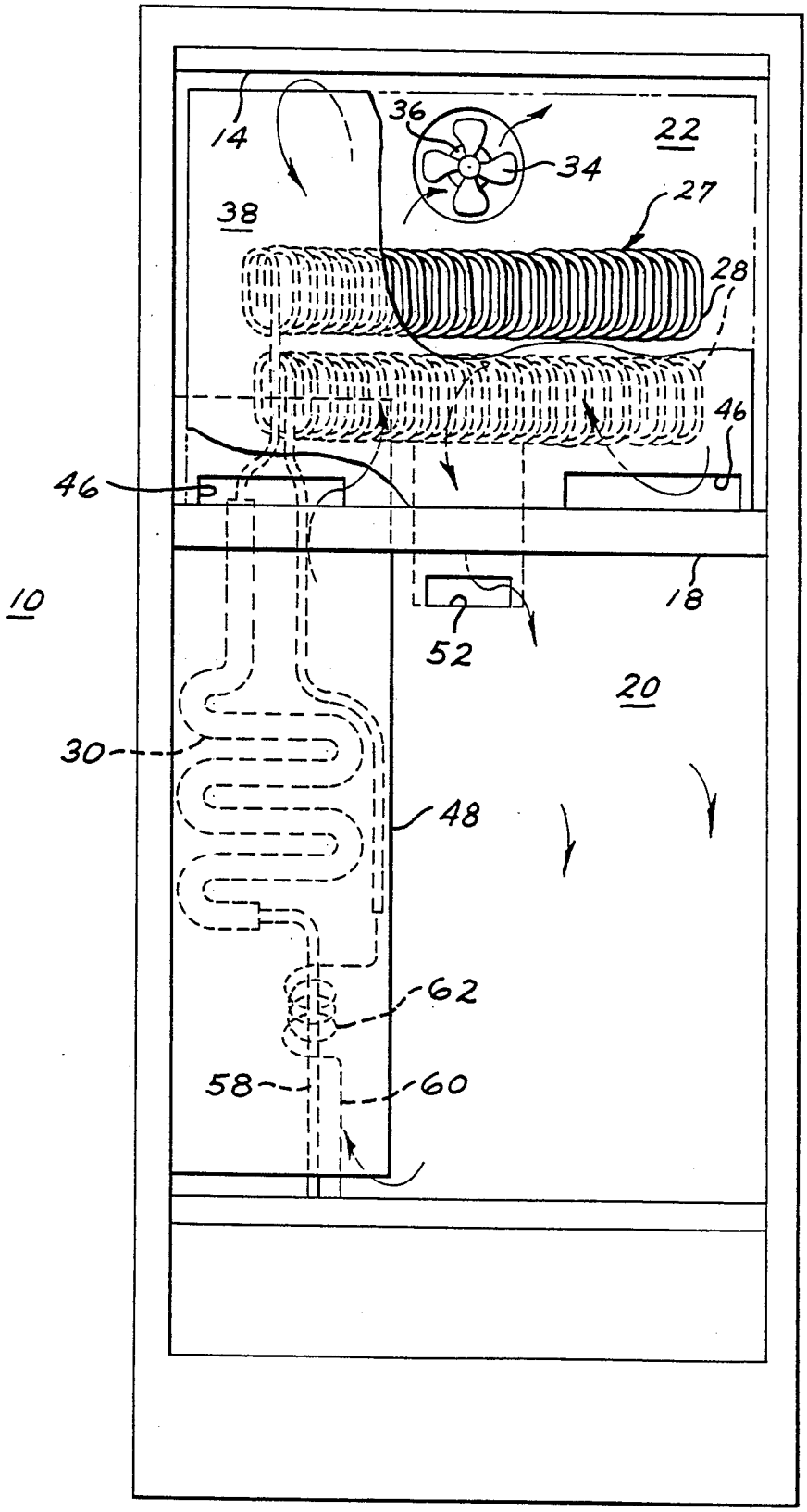
FIG. 2 is a partially schematic front elevational view of the refrigerator of FIG. 1 with the doors removed.

Referring now to the drawings there is shown a refrigerator 10 having a housing or cabinet 12 and an inner wall or shell 14 spaced from the housing. The space between the housing and shell is filled with thermal insulation 16 in a conventional manner.

An insulated horizontal partition 18 divides the interior of shell 14 into a lower compartment 20 and an upper compartment 22. The lower compartment is closed by a hinged door 24 and the upper compartment is closed by a hinged door 26. The lower or fresh food compartment 20 is maintained at a temperature above freezing, for example a nominal air temperature of 40° F., for the storage of various fresh foods. The upper compartment or freezer section 22 is maintained at a temperature below freezing, for example a nominal air temperature of 5° F., for storage of frozen foods.

Each of the compartments are maintained at its desired refrigerating temperature by means of an evaporator 27 including a first evaporator section 28 and a second evaporator section 30. Preferably both the first and second evaporator sections are formed as parts of a continuous length of heat exchange tubing. For directing air cooled by the evaporator into the two compartments 20 and 22, there is provided a forced air circulating system including a fan 34 driven by a motor 36.

A liner 38 positioned in the upper portion of the refrigerator includes a rear wall 40 spaced from the back of the shell 14 to form an evaporator chamber 44 and a lower wall 42 positioned above the partition 18 to form an air return passage 46 for movement of air from the freezer compartment 22 to the evaporator chamber 44. The top of the rear wall 40 is spaced below the upper surface of the shell 14 to provide an outlet passage 47 for air to move from the evaporator chamber to the freezer compartment. An elongated U shaped partition 48 is positioned in the rear of the fresh food compartment 20 and, in conjunction with the shell 14 forms an air return duct 50 for returning air from the fresh food compartment 20 to the evaporator chamber 44. The structure forming the evaporator chamber 44 and the air return duct 50 also form a second air outlet passage 52 for passing air from the evaporator chamber 44 to the fresh food compartment 20.

The first evaporator section 28 is positioned within the evaporator chamber 44 while the second evaporator section or evaporator extension 30 is positioned in the air return duct 50. The fan 34 is mounted above of the first evaporator section 28. During operation refrigerant passing through the two evaporator sections cools them. The fan draws air from the freezer compartment through the passage 46 and draws air from the lower portion of the fresh food compartment 20 through the air return duct 50 to the evaporator chamber 44. The freezer return air passing through passage 46 is nominally at 5° F. while the air entering in the lower end of duct 50 from the fresh food compartment is nominally at 40° F. The second evaporator section or evaporator extension 30 chills the fresh food return air to about 5° F. so that it and the freezer return air are at approximately the same temperature as they are mixed together and pass over the first evaporator section 28. The first evaporator section is effective to chill the total volume air to nominally −10° F. A portion of this air then is moved by the fan 34 over the top of the rear wall 40 into the freezer compartment and the remainder is directed through the air outlet passage 52 into the upper portion of the fresh food compartment 20. The use of two evaporator sections more efficiently utilizes the capacity of the system.

Additionally, most of the moisture in the air returned to the evaporator for chilling is entrained in the fresh food return air. Evaporator extension 30 is sized, positioned and operated to effectively remove most of this moisture and deposit it on evaporator extension as frost. This results in smaller deposits of frost on the first or main evaporator section 28 which prolongs the permissable interval between the defrost operations of the main evaporator.

The evaporator is part of a typical refrigeration system which also includes a compressor 54 and a condenser 56. These components are located in a machinery compartment below the shell 14 and are interconnected. The evaporator extension 30 is connected to the compressor 54 by a suction line 58 while the condenser 56 is connected to the first evaporator section 58 by a capillary 60 to complete the refrigeration loop.

Typically in prior art refrigerators the suction line and capillary are positioned outside of the insulated housing of the refrigerator and in heat exchange relationship with each other. Preferably with the present invention the suction line 58 and capillary 60 extend through the air return duct 50 and are positioned in heat exchange relationship with each other as indicated by the coil 62. This further improves the efficiency of operation of the refrigeration system.

When the compressor is turned off the temperature within the air duct 50 rises for a number of reasons as summarized below here. There is still hot refrigerant in the capillary tube 60, the surrounding air of the fresh food compartment is at 40° F. as compared to about 5° F. for the upper portion of the evaporator extension, some heat exchange occurs through the insulated rear wall of the refrigerator to the duct 50 and there is natural convection of air from the fresh food compartment 20 upwardly through the duct 50. These factors are adjusted so that, in normal operation, each time the compressor turns off the frost accumulated on the evaporator extension 30 melts and runs down the duct 50. From there it is conveyed to the outside of the housing by tube 64 and falls into a pan 66 located in the lower portion of the machinery compartment. The heat from the compressor and condenser cause the moisture in pan 66 rapidly to be evaporated into the surrounding atmosphere.

The foregoing is a description of a preferred embodiment of the present invention and it should be understood that variations may be made thereto without departing from the true spirit of the invention as defined in the appending claims.

What is claimed is:

1. A refrigerator including:

an upper freezer compartment, a lower fresh food compartment and an insulating partition separating said compartments;

an evaporator chamber separate from said freezer and fresh food compartments and above said fresh food compartment;

means for conducting relatively cold air from said chamber to said freezer compartment and means for conducting relatively cold air from said chamber to said fresh food compartment;

return means for returning relatively warm air from said freezer compartment to said chamber;

duct means connecting the lower portion of said fresh food compartment with said chamber for returning relative warm air from said fresh food compartment to said chamber;

evaporator means, including a first evaporator section positioned in said evaporator chamber and a second evaporator section positioned in said duct means, for cooling air passing thereover; and fan means for withdrawing relatively warm air from said compartments, circulating the air from said freezer compartment over said first evaporator section, circulating the air from said fresh food compartment serially over both said second and first evaporator sections and discharging cooled air from said evaporator chamber.

2. The refrigerator of claim 1 wherein said return means and said duct means are positioned and arranged to cause air from the freezer compartment and air from said fresh food compartment to be co-mingled as it circulates over said first evaporator section.

3. The refrigerator of claim 1 wherein said second evaporator section is effective to reduce the temperature of the air withdrawn from said fresh food compartment to substantially the temperature of the air being withdrawn from said freezer compartment.

4. The refrigerator of claim 1 wherein said first and second evaporator sections are formed from a continuous length of heat exchange tubing.

5. The refrigerator of claim 1 further including condenser means and conduit means for conducting condensed refrigerant from said condenser means to said evaporator means, said conduit means being positioned in heat exhange relationship with said second evaporator section.

6. A refrigerator including:

insulating walls defining a storage volume;

a horizontal insulating partition dividing said volume into a freezer compartment and a fresh food compartment, each having an access opening at the front thereof; door means for closing each of said access openings.

an evaporator chamber above said horizontal partition and rearward of said freezer compartment, a generally vertical partition separating said chamber from said freezer compartment;

first air outlet passage connecting the upper portion of said chamber and said freezen compartment and an air return passage connecting the lower portions of said chamber and said freezer compartment;

second air outlet passage connecting the upper portions of said chamber and said fresh food compartment;

an air return duct within said insulating walls and connecting the lower portions of said fresh food compartment and said evaporator chamber;

evaporator means having a first evaporator section positioned in said evaporator chamber and a second evaporator section positioned in said air return duct; and fan means for circulating air cooled by said evaporator from said evaporator chamber through said first and second air passages to and freezer and fresh food compartments and returning relatively warm air from said compartments to said chamber through said air return passage and said air return duct.

7. The refrigerator of claim 6 wherein said second evaporator section is effective to reduce the temperature of air entering said evaporator chamber from said air return passage to substantially the temperture of the air entering said evaporator chamber from said air return passage.

8. The refrigerator of claim 6 wherein said first and second evaporator sections are formed from a continuous length of heat exchange tubing.

9. The refrigerator of claim 6 further including condenser means and conduit means for conducting condensed refrigerant from said condenser means to said evaporator means, said conduit means being in heat exchange relationship with said second evaporator sections within said air return duct.

10. The refrigerator of claim 6 further including a drain tube for conducting defrost water from said air return duct to outside said insulating walls.

* * * * *